US006216656B1

(12) United States Patent
Hada et al.

(10) Patent No.: US 6,216,656 B1
(45) Date of Patent: Apr. 17, 2001

(54) SURGE TANK STRUCTURE IN INTAKE MANIFOLD

(75) Inventors: Masatoshi Hada, Nagoya; Yasuo Sunaga, Koga, both of (JP)

(73) Assignees: Aichi Kikai Kogyo Kabushiki Kaisha, Nagoya; Sanoh Kogyo Kabushiki Kaisha, Koga, both of (JP)

( * ) Notice: Subject to any disclaimer, the term of this patent is extended or adjusted under 35 U.S.C. 154(b) by 0 days.

(21) Appl. No.: 09/547,331

(22) Filed: Apr. 11, 2000

(30) Foreign Application Priority Data

Apr. 19, 1999 (JP) ..... 11-111513

(51) Int. Cl.[7] ..... F02M 35/10

(52) U.S. Cl. ..... 123/184.34; 123/184.47

(58) Field of Search ..... 123/184.24, 184.34, 123/184.42, 184.47

(56) References Cited

FOREIGN PATENT DOCUMENTS 2-224836 * 9/1990 (JP) .

* cited by examiner

*Primary Examiner*—Noah P. Kamen
(74) *Attorney, Agent, or Firm*—Dennison, Scheiner, Schultz & Wakeman

(57) ABSTRACT

A surge tank structure in an intake manifold has a serge tank to which a plurality of branch tubes are joined at one end. The branch tubes are joined at the other end to a cylinder head mounting flange, and one end of each branch tube in the surge tank is enlarged to have a horn-like shape. The serge tank comprises a main body and a top plate. The main body has through holes provided therein for accepting the branch tubes and has its top side opened. The top plate is joined in a plane to the top of the main body. The main body has a bottom which has engagement recesses formed by raised portions, so that each engagement recess has a horn-like surface that conforms to the horn-like shape of one end of each branch tube.

2 Claims, 10 Drawing Sheets

SURGE TANK STRUCTURE IN INTAKE MANIFOLD

BACKGROUND OF THE INVENTION

1. Field of Industrial Applications

The present invention relates to a surge tank structure in an intake manifold.

2. Related Art

In general, an intake manifold for use in an automobile gasoline or diesel engine has such a structure as shown in FIG. 9, where a plurality of branch tubes 2 are joined at one end to a cylinder head mounting flange 4 provided for installation on a cylinder head and at the other end to a surge tank 3. FIG. 10 illustrates an enlarged cross sectional view of the joint between the branch tubes 2 and the surge tank 3. Each branch tube 2 is connected and inserted into the surge tank 3. The inner wall for accepting the leading end of the branch tube 2 has a horn-like region 51 formed by changing the diameter for the purpose of moderating a change of the cross section so that the load of a suction caused by abrupt change in the cross section can be reduced. The surge tank 3 is fabricated by casting using a core for shaping the horn-like regions 51, and the use of such a core increases production costs.

To reduce costs, a modification has been proposed, which is shown in FIG. 11 and FIG. 12, which is a cross sectional view taken along the line XII—XII of FIG. 11. Here, the leading end of each branch tube 2 is flared or enlarged in its diameter to produce a horn-like flared or enlarged region 2*a* and is then mounted to a surge tank 3. The surge tank 3 comprises two separable components, a lower member 52 and an upper member 53. More specifically, after the branch tubes 2 having the horn-like flared or enlarged regions 2*a* have been set in their position, the upper member 53 is joined to the lower member 52 to complete the surge tank 3. The joint between the branch tube 2 and the two tank members 52 and 53 includes semi-circular and straight regions, thus requiring higher degrees of the roundness of the overall dimensions of the branch tubes 2 and a more accurate machining of the joining portions of the lower member 52 and the upper member 53 to the branch tubes 2. In addition, a set of pins 54 is needed for positioning the lower member 52 and the upper member 53, thereby increasing the manufacturing cost. Moreover, any displacement between the branch tubes 2 and the two tank members 52 and 53, may disadvantageously cause the condensed liquid or blow-by oil 0 deposited on the bottom of the lower member 52 to remain there since the condensed liquid may not be sucked into the branch tubes 2.

SUMMARY OF THE INVENTION

The present invention has been developed in view of the above problems and its object is to provide an intake manifold which allows condensed water or blow-by oil deposited in a surge tank to be favorably discharged which can also be fabricated at lower cost without the use of cores in the casting molds. According to the present invention, a surge tank structure is provided in an intake manifold having a surge tank to which a plurality of branch tubes are joined at one end. Each branch tube is joined to a cylinder head mounting flange at one end, and the surge tank is flared or enlarged to have a horn-like shape. The surge tank comprises a main body and a top plate. The main body has through holes provided therein for accepting the branch tubes and has an open top side. The top plate is joined in a plane to the top of the main body. The main body has a bottom which has engagement recesses formed by raised or raised portions, so that each engagement recess has a horn-like surface that conforms to the horn-like shape of one end of each branch tube end.

The main body and the top plate are joined with each other in a plane, and the surge tank is tightly sealed off at the joint. Also, the branch tube is precisely positioned in the engagement recess provided in the bottom of the main body so that the horn-like shape of the branch tube end closely contacts the horn-shape surface of the bottom, hence facilitating its function of sucking up a pool of condensed water or blow-by oil deposited on the bottom of the surge tank. In other words, the structure of the surge tank is improved while fouling by condensed water or blow-by oil is reduced. Also, the surge tank can be fabricated at a lower cost since no core is used in the molds.

Preferably, after each branch tube has been inserted into its respective through holes and has been positioned in its respective engagement recesses in the main body of the surge tank, an enlarging tool is inserted from above into the main body to urge one end of each branch tube against the corresponding horn-like surface and to enlarge the same to have the horn-like shape.

Accordingly, the process can be implemented at a lower cost by removing the top plate, setting the branch tubes to the through holes in the main body, inserting the die into the main body, and performing an enlarging or flaring process with the end of each the branch tube closely contacting the horn-shape surface.

DETAILED DESCRIPTION OF THE INVENTION

One preferred embodiment of the present invention will be described with reference to the drawings.

Figure 1:
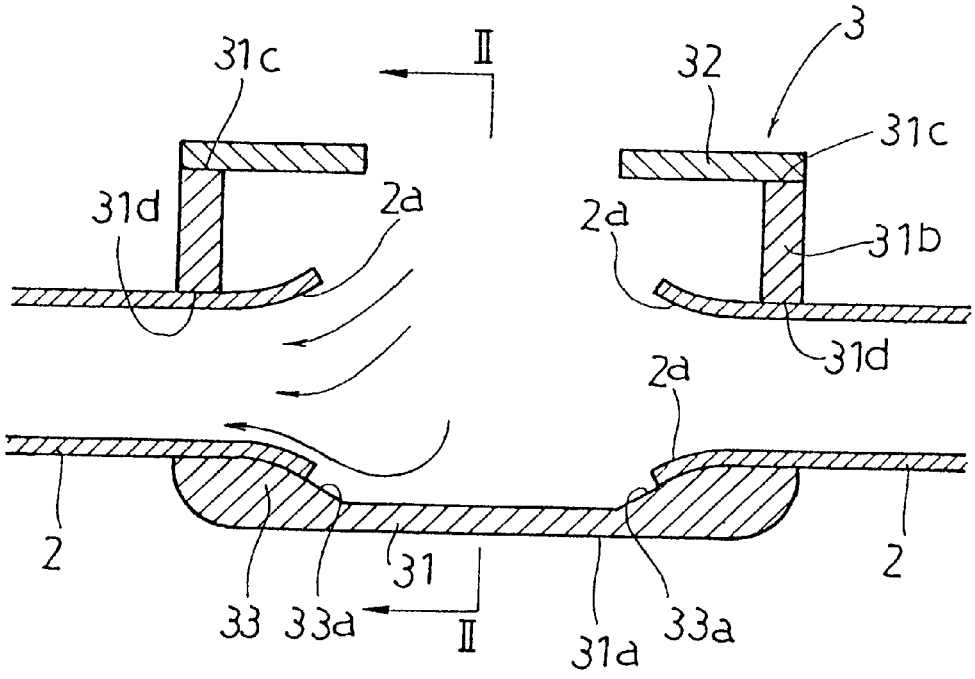
FIG. 1 is a cross sectional structural view showing branch tubes joined to a surge tank.
Figure 2:
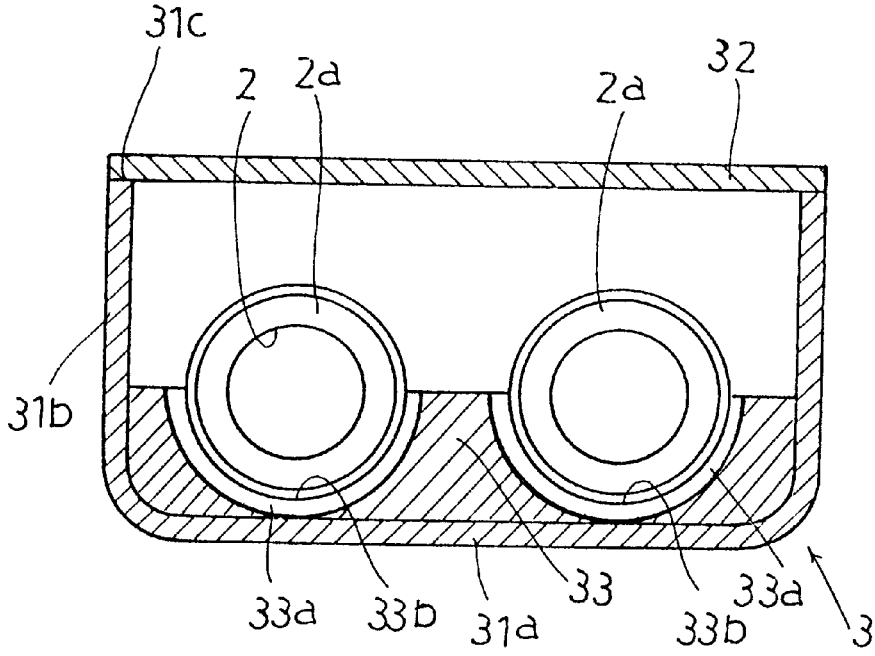
FIG. 2 is a cross sectional structural view taken along the line II—II of FIG. 1.

FIG. 1 is a cross sectional structural view showing branch tubes 2 joined to a surge tank 3. FIG. 2 is a cross sectional structural view taken along the line II—II of FIG. 1.

In this embodiment, the surge tank 3 comprises a main body 31 and a top plate 32. The main body 31 has a box-like structure with a top side opening and includes a side wall 31*b* that extends upwardly from abottom 31*a*. The side wall 31*b* has through holes 31*d* for accepting the branch tubes 2 from the outside. The top of the side wall 31*b* is smooth and provides a horizontal joining surface 31*c*. The top plate 32 is joined to the joining surface 31*c* and is placed thereon from above, thus completing the overall structure of the surge tank 3. As the interface between the top plate 32 and the main body 31 is flat, the top plate 32 and the main body 31 can be joined to be reliably sealed.

Also, the bottom 31*a* of the main body 31 has thickened or raised portions 33 arranged beside the through holes 31*d*. The raised portion 33 also has, as best shown in FIG. 2, semi-circular engagement recesses 33*b* provided therein to conform to the outer configuration of the branch tubes 2, so that the leading ends of the branch tubes 2 are positioned precisely in their joining locations. In particular, an inner end portion of each engagement recess 33*b* defines a horn-shape surface 33*a* which curves down to the bottom 31*a* of the main body 3.

Each engagement recess 33*b* is tailored in an arc shape that is less than half the circumferential length of the branch tube 2. This obviates the need for a core in making the main body 31 with the raised portion 33 the horn-shape surfaces 33*a* and the engagement recesses 33*b*, hence minimizing the cost of casting the main body 31. Also, the top plate 32 is tightly joined to the top of the main body 31, ensuring a higher sealing effect of the overall structure while requiring no use of pins as employed in the prior art. Accordingly, the manufacturing cost of the overall surge tank structure can further be reduced.

Figure 3:
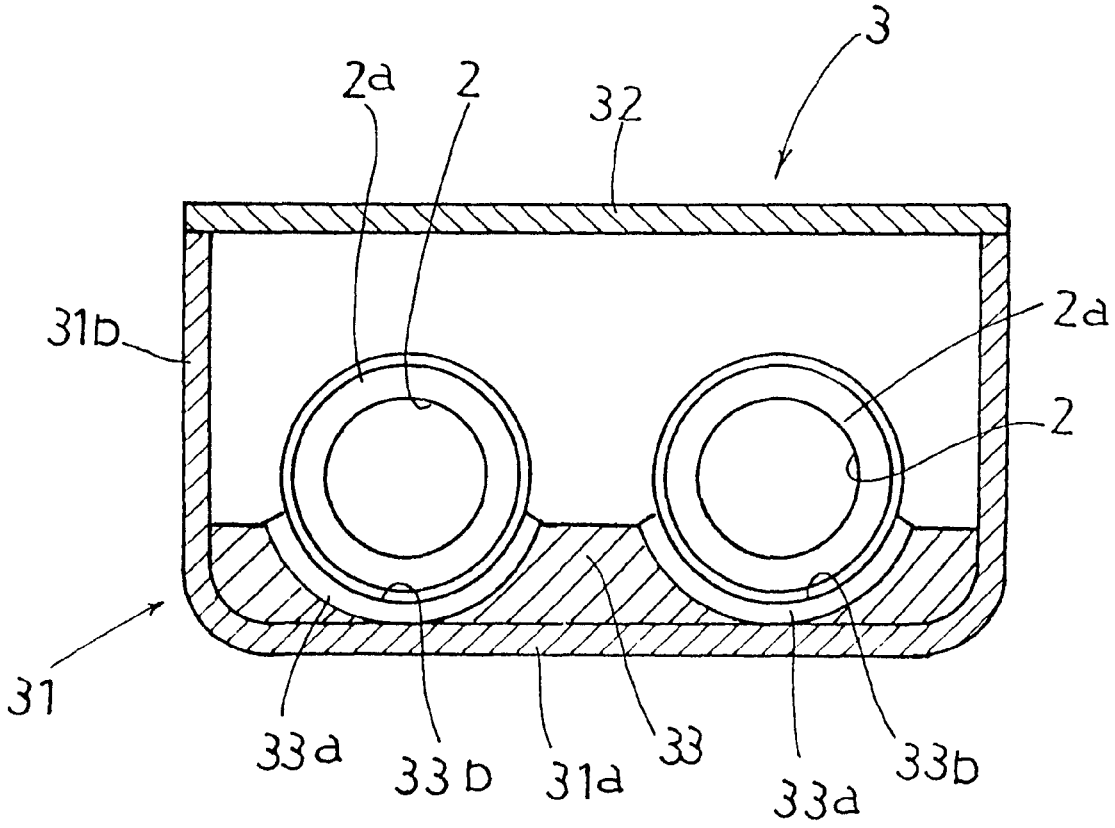
FIG. 3 is a cross sectional structural view showing engagement recesses formed to have a shallow depth.

As shown in FIG. 3, the raised portion 33 may be lowered as closer to the bottom 31 and its engagement recess 33*b* may be shallowly recessed to contact only a lower side of the outer periphery of the branch tube 2 positioned therein.

Figure 4:
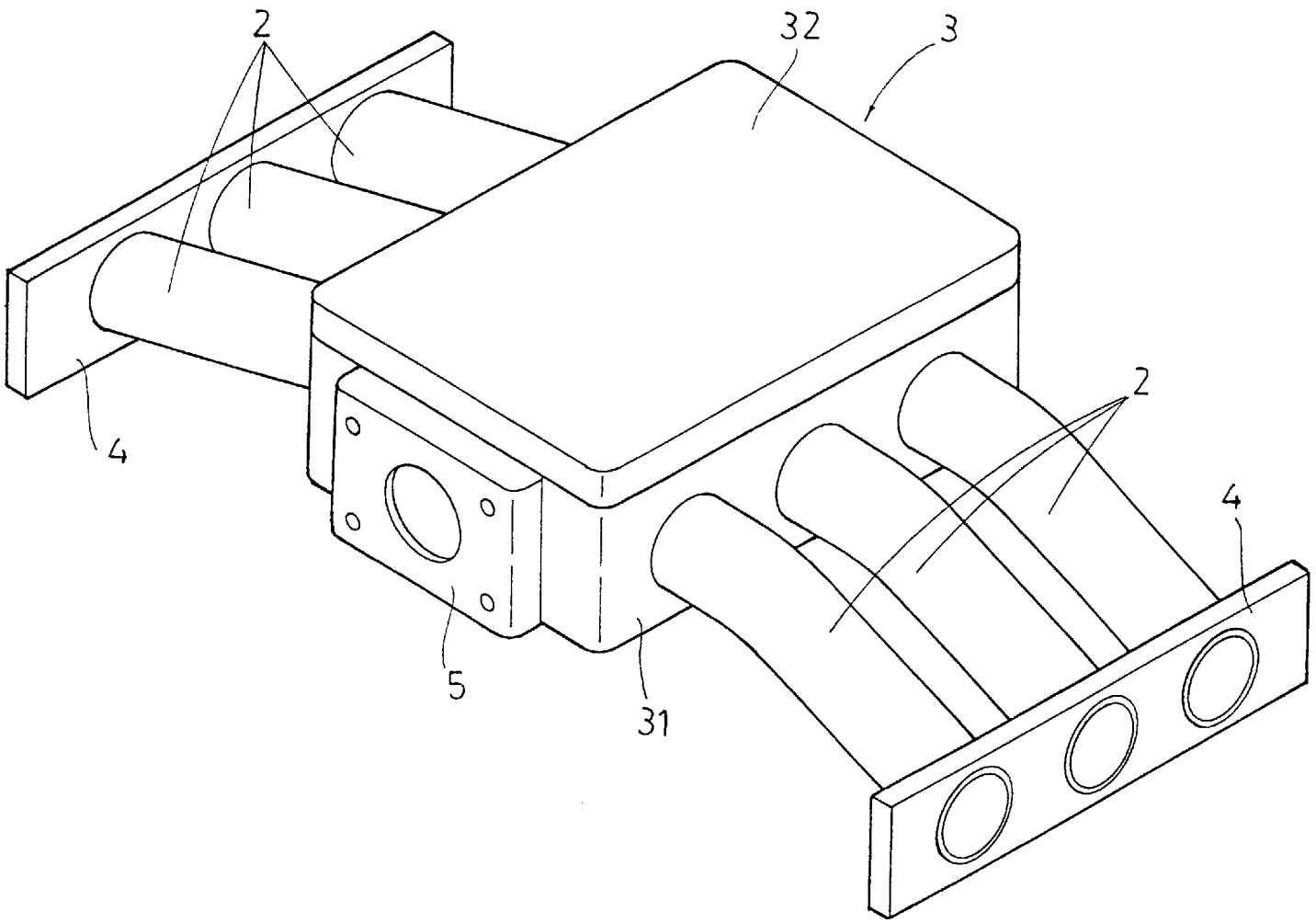
FIG. 4 is a perspective structural view of a separable structure of the surge tank.

Even if the surge tank structure is of a type with a throttle chamber mount 5 joined laterally to the main body 31 for introducing a flow of air into the interior of the surge tank 3, as shown in FIG. 4, the surge tank 3 may also have a separable structure comprising the main body 31 and the top plate 32, and the raised portions 33 with the engagement recesses 33*b* and the horn-shape surfaces 33*a* may also be provided on the bottom of the main body 31.

Figure 5:
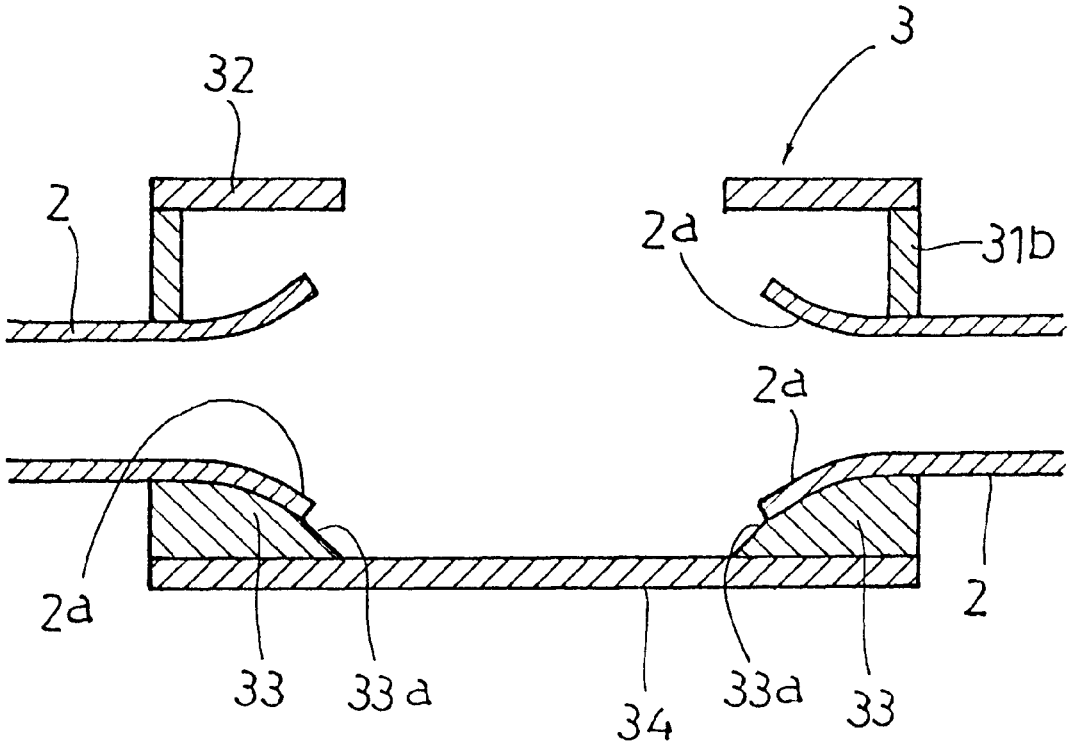
FIG. 5 is a cross sectional structural view showing the surge tank with a separate bottom plate.
Figure 6:
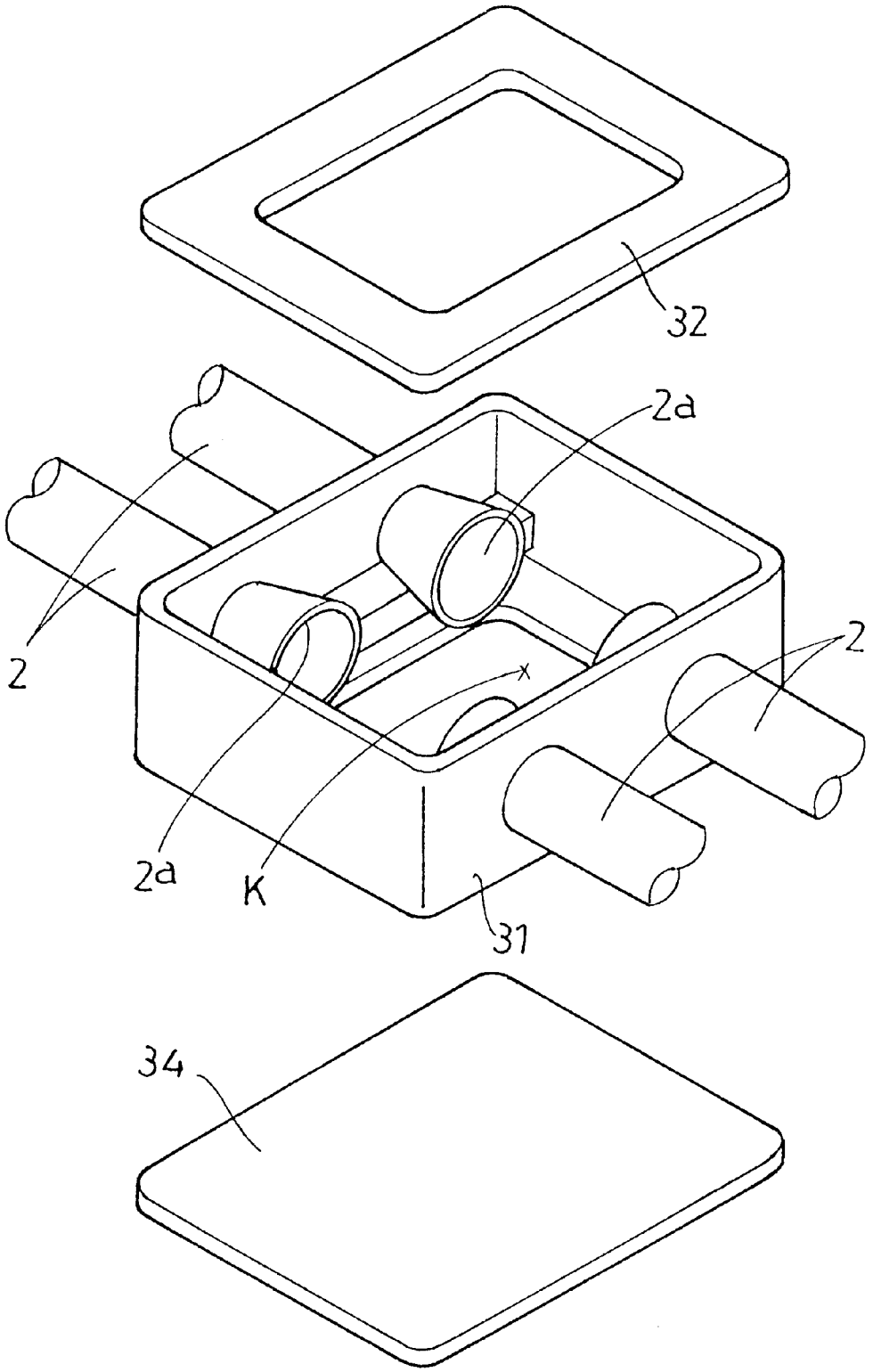
FIG. 6 is an exploded perspective view of the structure shown in FIG. 5.

Further, as shown in FIG. 5 by a cross sectional view and in FIG. 6 by an exploded perspective view, the bottom 31*a* of the main body 31 may be formed by a separate bottom plate 34 which can be removed from the main body 31.

Figure 7:
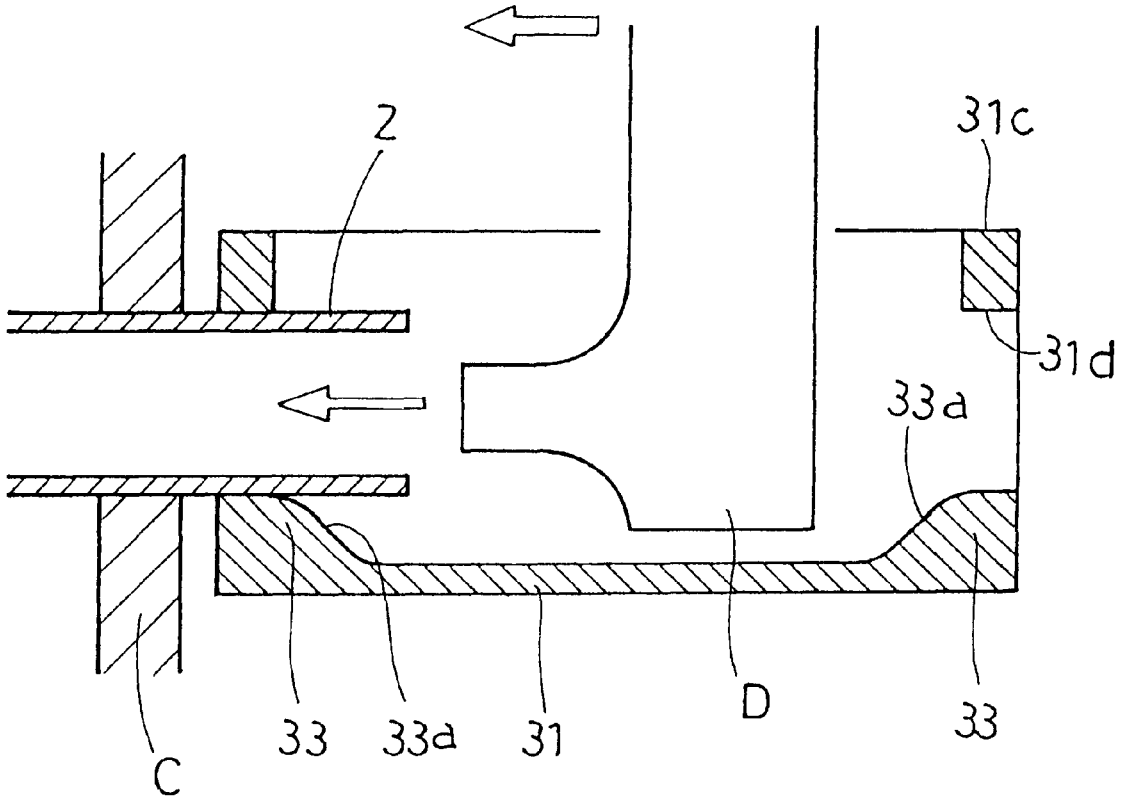
FIG. 7 is an explanatory view showing an enlarging process of the leading end of the branch tube using a die.

More specifically, for joining the branch tubes 2 to the main body 31 of the surge tank 3, as shown in FIG. 7, the leading end of each branch tube 2 is inserted from the outside into the through hole 31*a* in the main body 31 with the top plate 32 being removed. The leading end of the branch tube 2 is then positioned in the engagement recess 33*b*, and the branch tube 2 is fixed in position by a clamp C from the outside. Next, a die D is inserted from above into the main body 31 and pressed against the leading end of the branch tube 2 until the leading end of the branch tube 2 is bent to closely contact the horn-shape surface 33*a* of the raised portion 33 of the main body 31 and then yielded to form a horn-like flared or enlarged portion 2*a* which conforms to the horn-shape surface 33*a*. Because the leading end of the branch tube 2 closely contacts the horn-shape surface 33*a*, no positional discrepancy should occur. Therefore, any condensed water or blow-by oil deposited on the bottom of the main body 31 can favorably be sucked up by the branch tubes 2. In other words, little of any condensed water or blow-by oil is accumulated on the bottom of the main body 31. The die D is withdrawn when it has forced the loading end of the branch tube 2 to turn to the horn-like enlarged portion 2*a* and then, the top plate 32 is mounted to the top of the main body 31.

Figure 8:
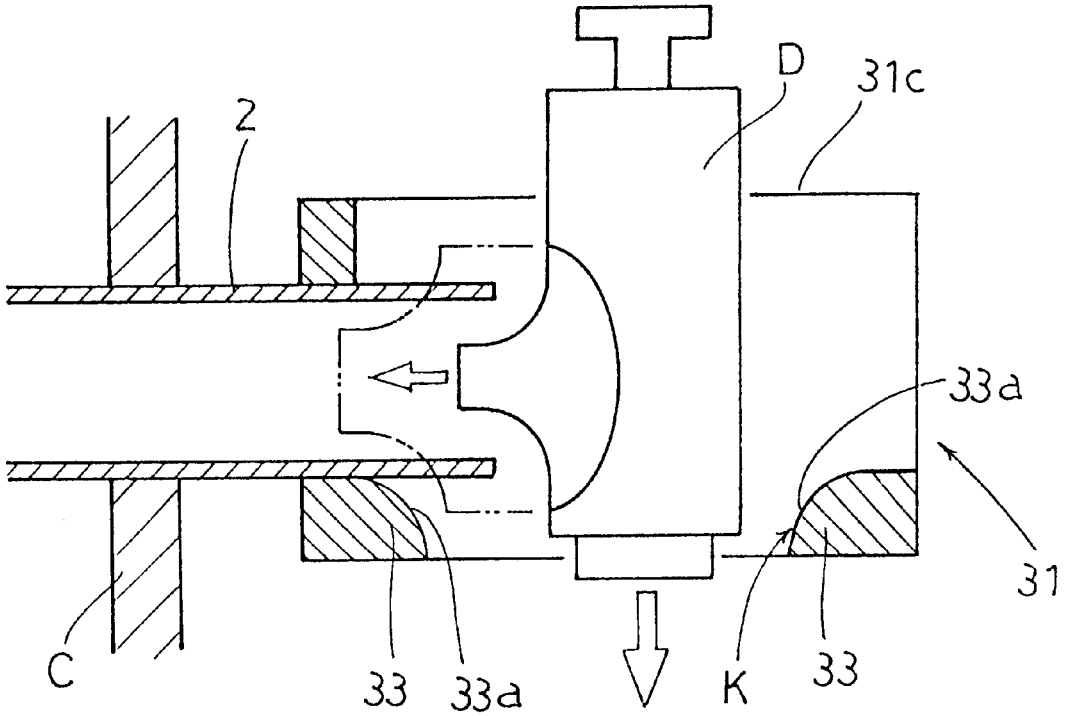
FIG. 8 is an explanatory view showing a process of removing the bottom plate and of enlarging the tube by using a die when the top opening is small.
Figure 9:
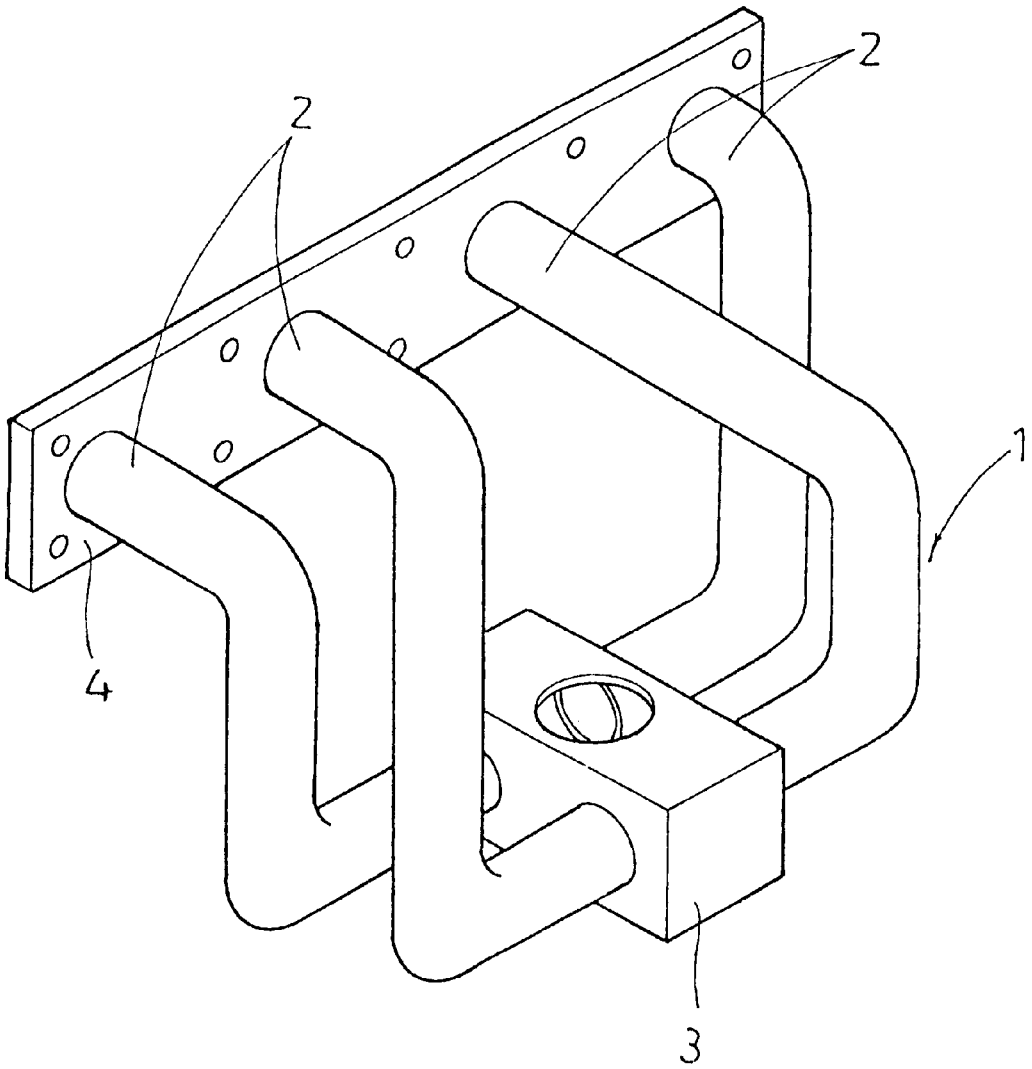
Fig 9 PRIOR ART
FIG. 9 is a perspective structural view of a conventional intake manifold.
Figure 10:
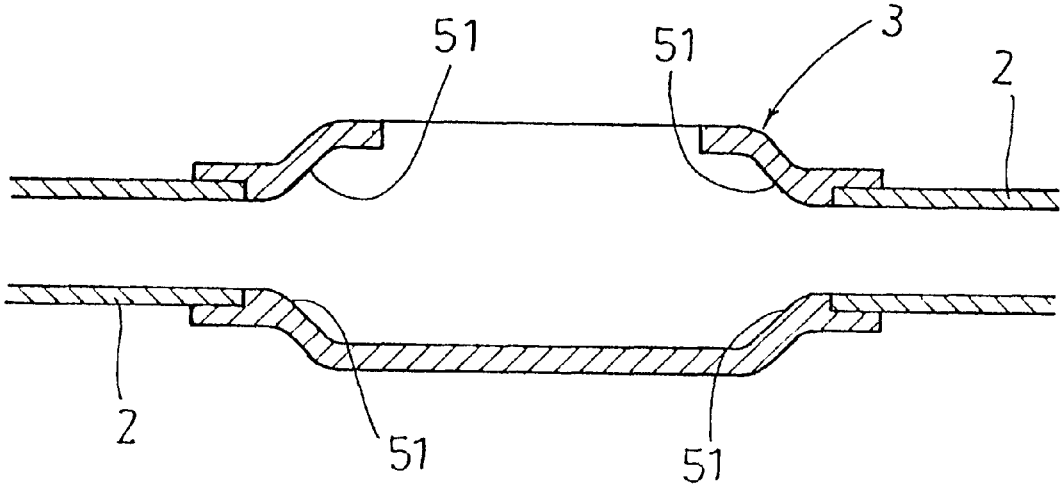
Fig 10 PRIOR ART
FIG. 10 is a cross sectional enlarged structural view showing the joint between a conventional surge tank and branch tubes.
Figure 11:
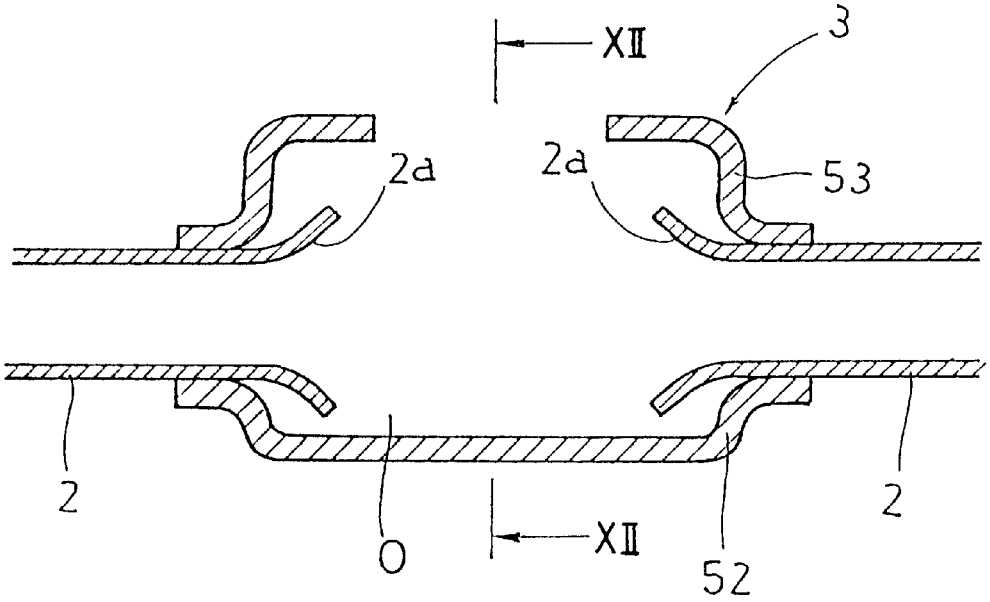
Fig 11 PRIOR ART
FIG. 11 is a cross sectional structural view showing the joint between a conventional separable type surge tank and branch tubes.
Figure 12:
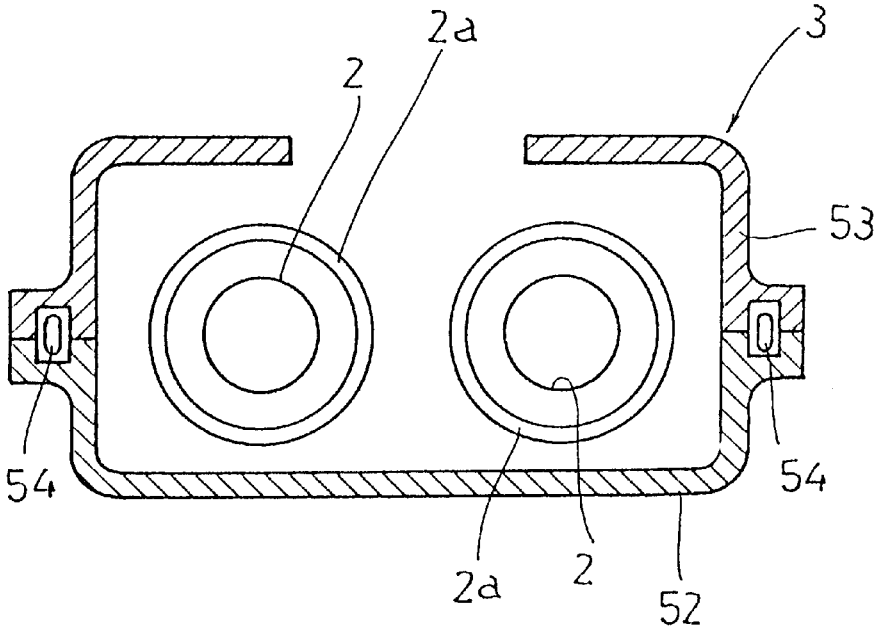
Fig 12 PRIOR ART
FIG. 12 is a cross sectional view taken along the line XII—XII of FIG. 11.

In the event that the top opening of the main body 31 is relatively small, the structure shown in FIGS. 5 and 6 is employed. Thus, as shown in FIG. 8, with the separate bottom plate 34 being removed, the leading end of the branch tube 2 can be effectively flared or enlarged by a die D that has a lower portion projecting downwardly from the lower opening K of the main body 31. After the leading end of the branch tube 2 has been shaped to the horn-like enlarged shape to closely contact the horn-shape surface 33*a*, the die D is withdrawn and the separate bottom plate 34 is mounted to the bottom of the main body 31 to close the lower opening K. Then, the top plate 32 is mounted to the top of the main body 31 to complete the surge tank 3.

While the leading end of the branch tube 2 is being shaped by the die D to have the horn-like enlarged portion 2*a*, the branch tube 2 is positioned in the engagement recess 33*b* and its inward end is pressed against the horn-shape surface 33*a*. Therefore, the engagement recess 33*b* and the horn-shape surface 33 serve as a backup tool, thus contributing to the better performance of the horn-shape forming action.

What is claimed is:

1. A surge tank structure in an intake manifold having a surge tank to which a plurality of branch tubes are joined at one end while the branch tubes joined at the other end to a cylinder head mounting flange, one end of each branch tube in the surge tank being enlarged to have a horn-like shape, the surge tank comprising a main body and a top plate, the main body having through holes provided therein for accepting the branch tubes and having its top side opened, the top plate being joined in a plane to the top of the main body, the main body having a bottom which has engagement recesses formed by raised portions, so that each engagement recess has a horn like surface that conforms to the horn-like shape of one end of each branch tube.

2. A surge tank structure in an intake manifold according to claim 1, wherein after each branch tube has been inserted into the respective through holes and have been positioned in the respective engagement recesses in the main body of the surge tank, an enlarging tool is inserted from above into the main body so as to urge one end of each branch tube against the corresponding horn-like surface and to enlarge the same to have the horn-like shape.

* * * * *